United States Patent [19]

Kondo et al.

[11] 4,089,196

[45] May 16, 1978

[54] METHOD OF CONTROLLING INTER-STAND TENSION IN ROLLING MILLS

[75] Inventors: Katsuya Kondo; Tomio Yamakawa, both of Amagasaki, Japan

[73] Assignee: Sumitomo Metal Industries, Ltd., Osaka, Japan

[21] Appl. No.: 781,327

[22] Filed: Mar. 25, 1977

[30] Foreign Application Priority Data

Mar. 26, 1976 Japan ..... 51-33212
Mar. 12, 1977 Japan ..... 52-27477

[51] Int. Cl.[2] ..... B21B 37/06

[52] U.S. Cl. ..... 72/12; 72/19; 72/21; 72/205

[58] Field of Search ..... 72/6, 8, 9–12, 72/21, 205, 19

[56] References Cited

U.S. PATENT DOCUMENTS 3,222,900 12/1965 Helsing ..... 72/21
3,290,912 12/1966 Reid ..... 72/12 X

*Primary Examiner*—Milton S. Mehr

*Attorney, Agent, or Firm*—Fleit & Jacobson

[57] ABSTRACT

There is disclosed a method of controlling inter-stand tension in rolling mills in which a tension measuring device is provided on each stand. The tension measuring device comprises a pair of load sensing devices provided respectively at the entry and delivery sides of the roll stand. Difference between outputs from the pair of load sensing devices is used as an output value of the tension measuring device. First, while a workpiece is captured by the second stand but is not yet captured by the third stand and when the tension in the workpiece between the first and second stands is consistent with a desired value, the output value from the tension measuring device of the second stand is stored. After the workpiece has been captured by the third stand, the difference between the stored output value and the output value from the tension measuring device of the second stand is used as the measured value of tension. The tension control for the workpiece between the second and third stands is carried out on the basis of the difference between the measured value and a desired value of tension between the second and third stands.

17 Claims, 12 Drawing Figures

| | | |
|---|---|---|
| FIG.5A | FIG.5B | FIG.5C |

METHOD OF CONTROLLING INTER-STAND TENSION IN ROLLING MILLS

This invention relates in general to a method of controlling a multi-stand rolling mill, and more particularly to a method of controlling inter-stand tension of a workpiece being rolled in a multi-stand rolling mill.

During the rolling operation of a multi-stand hot rolling mill used to roll products such as rounds, rod wires or the like, if excessive compressive force acts on a workpiece between a given pair of stands of the rolling mill, the workpiece will tend to bow between the pair of stands and in an extreme case to deflect from the pass line of the rolling mill. On the other hand, if excessive tension acts on the workpiece between the pair of stands, the workpiece will tend to slip at the roll nip, and the associated motor will be overloaded and as a result the safety circuit for the motor will be tripped to stop all stands of the rolling mill. In an extreme case, the workpiece will neck down or decrease in width and in thickness, and will often break. Wide variations in the inter-stand compressive and tensile force will cause trouble in the rolling mill operation and have detrimental effects on the rolled product gauge or shape.

In order to eliminate such inconvenience in the rolling operation, it has heretofore been known to be important to ceaselessly maintain the inter-stand tension of the workpiece between the given stands at a desired value, and various proposals to this end have been made and carried out.

In order to perform control of the rolling mill so as to maintain constant inter-stand tension, means is first necessary to detect workpiece tension between the various stands of the rolling mill. In the specification, the term "tension" is used to include compressive force which is expressed as negative tension. For this purpose, heretofore, various methods and means have been developed for detecting the inter-stand tension. One of these methods was to measure tension on the basis of the magnitude of the roll driving motor current in a given rolling mill stand. Another method was based on detecting the magnitude of rolling load in a given roll stand in addition to detecting the magnitude of the roll driving current. In cooperation with any of the above-mentioned and the other tension measuring methods, various methods of controlling the rolling mill have been proposed and reduced to practice.

However, the conventional rolling mill controlling methods were disadvantageous because the conventional tension measuring methods have certain inherent disadvantages common to all of the methods which use the roll driving motor current as the basis of tension measurement. Namely, the roll driving motor current is changed by change in temperature and gauge of the workpiece being rolled and by acceleration and deceleration of the roll driving motor, resulting in error in measurement of tension. Therefore, accurate tension measurement could not be obtained.

Recently, measuring devices have been developed which have eliminated the above-mentioned defects of the conventional devices and which enable a more accurate tension measurement. The recently developed measuring devices are adapted to direct detection of the inter-stand workpiece tension acting on the housing of the rolling stands through the rolls.

However, no method of controlling the inter-stand tension has yet been developed which uses such highly accurate tension measuring devices effectively utilizing its high accuracy and which is advantageous in actual rolling operation.

Therefore, one object of this invention is to provide a new inter-stand tension controlling method for use in cooperation with multi-stand rolling mills which more precisely controls the actual inter-stand tension to a desired or reference tension.

Another object of this invention is to provide a new inter-stand tension controlling method which performs control of the inter-stand tension by more exactly measuring the inter-stand tension of the workpiece between a given pair of stands of the rolling mill.

A further object of this invention is to provide an inter-stand tension control method which is performed on the basis of a more exact interstand tension value obtained by correcting the measured value from the tension measuring device by a correction coefficient derived from the diameter of the roll and the position of the pass of the roll being used.

A still further object of this invention is to provide an inter-stand tension control method in which tension deviation is determined taking into consideration interaction between the inter-stand tension of a given pairs of stands and the inter-stand tensions of other pairs of stands when a workpiece is rolled by three or more rolling stands.

Still another object of this invention is to provide an inter-stand tension control method in which when the trailing end portion of a workpiece has passed through any rolling stand, a control signal for that rolling stand is held so that rolling of the leading end portion of the next workpiece will be performed as smoothly and effectively as it was for the trailing end portion of the preceding workpiece.

The above and the other objects and advantages of this invention are accomplished by a method of controlling inter-stand tension in a multi-stand rolling mill which is provided with a means for measuring tension acting on a workpiece portion between a given $(i)$th stand and the next succeeding $(i+1)$ stand, which method comprises the steps of storing an output value from the tension measuring means in the condition where the workpiece is captured in the $(i)$th stand and has not yet been captured in the next succeeding $(i+1)$th stand and when the tension of the workpiece upstream of the $(i)$th stand substantially has reached a reference or desired value; multiplying, after the workpiece has been captured in the next $(i+1)$th stand, a difference value between the output value from the tension measuring means and the stored value by a predetermined correction coefficient $k$ to obtain the value of actual tension acting on the workpiece between the $(i)$th and $(i+1)$th stands; and performing control of the rolling speed on the basis of the error or deviation between the tension value and a desired tension value for the $(i)$th $-$ $(i+1)$th inter-stand.

In the above inter-stand tension control method, if the $(i)$th stand is the first stand of the rolling mill, the output from the tension measuring means may be stored immediately after the leading end of the workpiece has been captured in the $(i)$th stand. In the case that the $(i)$th stand is the second or a subsequent stand, when the tension of the workpiece between the $(i)$th stand and the adjacent upstream $(i-1)$th stand becomes consistent with a reference or desired value or differs from the desired value by less than a certain amount, the output value from the tension measuring means may be stored.

Furthermore, during the period when the tension of the workpiece between the ($i$)th and ($i+1$)th stands differs from the desired value by less than said certain amount, the output value from the tension measuring means may be averaged and the averaged value is stored.

According to one preferable mode of this invention, in a multi-stand rolling mill which is provided with an ($i$)th tension measuring means for measuring tension acting on a workpiece between an ($i$)th stand and the adjacent downstream ($i+1$)th stand and an ($i+1$)th tension measuring means for measuring tension of the workpiece between the ($i+1$)th stand and the adjacent downstream ($i+2$)th stand, during the time period from the moment the leading end of the workpiece has been captured in the ($i+2$)th stand to the moment the trailing end of that workpiece has passed through the ($i$)th stand, the ($i$)th − ($i+1$)th inter-stand tension control is performed on the basis of a value which is obtained by multiplying ($i$)th − ($i+1$)th inter-stand tension error or deviation derived from the output value of the ($i$)th tension measuring means and ($i+1$)th − ($i+2$)th inter-stand tension error or deviation derived from the output value of the ($i+1$)th tension measuring means respectively by tension influence coefficients $\beta i, i$ and $\beta i, (i+1)$ which are respectively determined by rolling conditions and by summing these multiplied tension deviations.

In another preferable embodiment of this invention, an ($i-1$)th tension measuring means is further provided to measure tension acting on the workpiece between the ($i$)th stand and the adjacent upstream ($i-1$)th stand, and during the time period from the moment the leading end of the workpiece has been captured in the ($i+2$)th stand to the moment the trailing end of that workpiece has passed through the ($i-1$)th stand, the ($i$)th − ($i+1$)th inter-stand tension control is performed on the basis of a value which is obtained by multiplying ($i-1$)th − ($i$)th inter-stand tension error or deviation derived from the output value of the ($i-1$)th tension measuring means, ($i$)th − ($i+1$)th inter-stand tension error or deviation derived from the output value of the ($i$)th tension measuring means and ($i+1$)th − ($i+2$)th inter-stand tension error or deviation derived from the output value of the ($i+1$)th tension measuring means respectively by tension influence coefficients $\beta i, (i-1), \beta i, i$ and $\beta i, (i+1)$ which are respectively determined by rolling conditions and by summing these multiplied tension deviations.

The above and other objects and effects of this invention will become apparent from the following detailed description of preferred embodiments of this invention taking reference to the accompanying drawings, in which.

Figure 1:
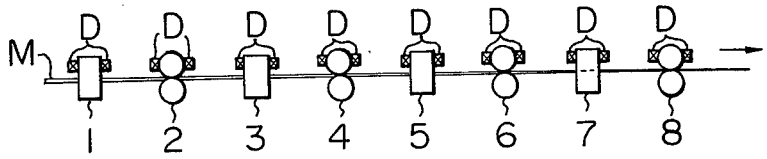
FIG. 1 is a diagrammatic illustration showing an eight-stand tandem rolling mill.

Referring now to FIG. 1, there is diagrammatically shown an eight-stand rolling mill to which the inter-stand tension controlling method according to this invention is applicable. A material or workpiece M is rolled through the first to eighth rolling stands in the direction of rolling shown by the arrow A. Of these rolling stands, those indicated with odd number are of the vertical roll type, whereas those indicated with even numbers are of the horizontal roll type. Such combination of vertical roll stands and horizontal roll stands is one mere example of a rolling mill train to which this invention is applicable, and therefore, it should be noted that the controlling method according to this invention can be applied not only to the above-mentioned arrangement but also to other various types of rolling mills.

Figure 2:
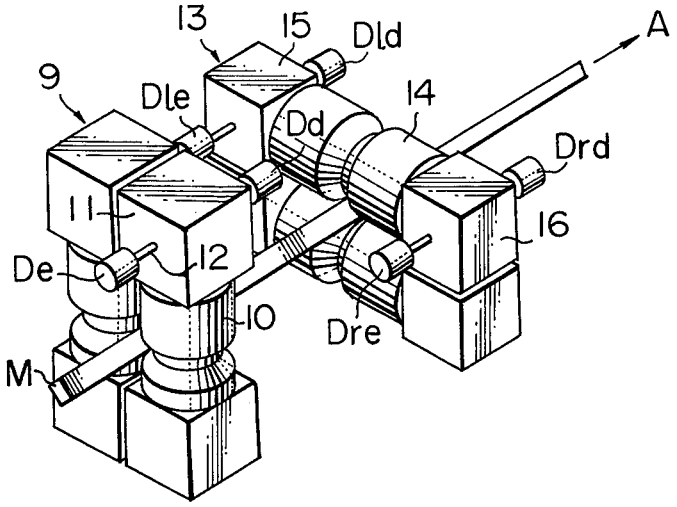
FIG. 2 is a diagrammatic perspective view of a vertical roll stand and a horizontal roll stand which are provided with load sensing devices mounted thereto.

To each of these rolling mill stands are provided one or two pairs of load sensing devices D of the direct detecting type as disclosed, for example, in Japanese Patent Public Disclosures 51-14078, 51-14079, 51-51978, 51-51980 and 51-59059 and the co-pending application Ser. No. 738061 filed on Nov. 2, 1976 and titled "Rolling Mill". The manner of mounting the load sensing devices D of this type to rolling stands is described in detail in the above-mentioned Japanese Patent Public Disclosures and the co-pending application and the following is only a brief explanation thereof. In a vertical roll stand 9 as shown in FIG. 2, two load sensing devices D*e* and D*d* are provided at the entry side and the delivery side of one roll chock 11 for one of work rolls 10, one to a side, in such a manner that the sensing rod 12 of each sensing device is in contact with the roll chock through a roll stand post (not shown). On the other hand, in a horizontal roll stand 13 as shown in FIG. 2, four load sensing devices D*le*, D*ld*, D*re* and D*rd* are provided at the entry side and the delivery side of roll chocks 15 and 16 provided at opposite ends of an upper work roll 14 in such a manner that the sensing rod 12 of each sensing device is in contact with the corresponding roll chock through a roll stand housing (not shown). These four load sensing devices may instead be provided to roll chocks of the lower work roll. The load sensing devices D*e* and D*d* constitute a tension measuring device for the roll stand 9, and the difference between the outputs from the load sensing devices D*e* and D*d* is outputted as an output of the tension measuring device. On the other hand, a tension measuring device for the horizontal roll stand is constituted by the load sensing devices D*le*, D*ld*, D*re* and D*rd*.

Now, the relationship between the force L detected by the tension measuring device and an actual horizontal force F in a workpiece acting on the rolling stand can be expressed by the following equation:

$$F = K \cdot L = (K_C \cdot K_D) \cdot L \qquad (1)$$

where

K: — correction coefficient $K_C$: — coefficient determined by rolling position on work roll $K_D$: — coefficient determined by work roll diameter.

Figure 3:
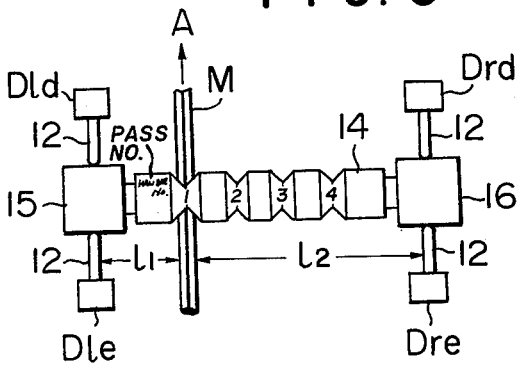
FIG. 3 is a diagrammatic plan view of a horizontal roll stand for showing the positional relation between the load sensing device and the rolling pass of the work roll.

FIG. 3 is a diagrammatic plan view of a horizontal roll stand of a rod steel mill, in which sensing rods 12 of load sensing devices D*le* and D*ld* are abutted against a roll chock 15 at the left side of a workpiece being rolled in the direction of the arrow and sensing rods 12 of load sensing devices D*re* and D*rd* are abutted against the right side roll chock 16. Assuming that the output of the load sensing devices D*le*, D*ld*, D*re* and D*rd* represent forces L*le*, L*ld*, L*re*, and L*rd*, respectively, the horizontal force F is expressed by the following equation:

$$F = K_D\{(L_{ld} - L_{le}) + (L_{rd} - L_{re})\} \quad (2)$$

Namely, in the case of measurement using four load sensing devices respectively provided at the entry side and the delivery side of the roll chocks on the opposite ends of one work roll as shown FIGS. 2 and 3, the horizontal force F can be obtained without regard to the rolling position on the roll.

Now, assume that the workpiece is being rolled by the first pass of four passes formed on the work roll 14, and assume that the distance from the first pass to the sensing rods of the left load sensing devices as $l_1$ and the distance between the first pass and the sensing rods of the right load sensing devices is $l_2$. Based on the rule of balance in force, the equation (2) can be converted into the following:

$$F = K_D \frac{l_1 + l_2}{l_2}(L_{1d} - L_{1e}) \quad (3)$$

$$= K_D \frac{l_1 + l_2}{l_1}(L_{rd} - L_{re}) \quad (3')$$

Furthermore, since the distance $l_1 + l_2$ is substantially equal to the longitudinal length $L_r$ of the work roll 14 ($L_r = l_1 + l_2$), the equations (3) and (3') can be expressed as follows:

$$F = K_D \frac{L_r}{L_r - l_1}(L_{1d} - L_{1e}) \quad (4)$$

$$= K_D \frac{L_r}{L_r - l_2}(L_{rd} - L_{re}) \quad (4')$$

Therefore, if only the left pair of load sensing devices are used in the tension measuring device shown in FIG. 3, the horizontal force F can be obtained on the basis of the equation (4). In the case that only the right pair of load sensing devices are used, the equation (4') will give the horizontal force F.

On the one hand, the coefficient $K_D$ is given by the following equation:

$$K_D = (aD + b)/(cD + d) \quad (5)$$

where

D:—work roll diameter

*a, b, c, d:—constant*

Thus, in the case of the horizontal roll stand 13 as shown in FIG. 2, since four load sensing devices are provided, one at the entry side and one at the delivery side of each roll chock of the pair of roll chocks journalling the associated work roll, the correction coefficient K is $K_D(K=K_D)$. In the case of the vertical roll stand 9, since load sensing devices are provided only on the right roll chock, the correction coefficient K is the product of $K_C$ and $K_D$ ($K=K_C \cdot K_D$).

Figure 4:
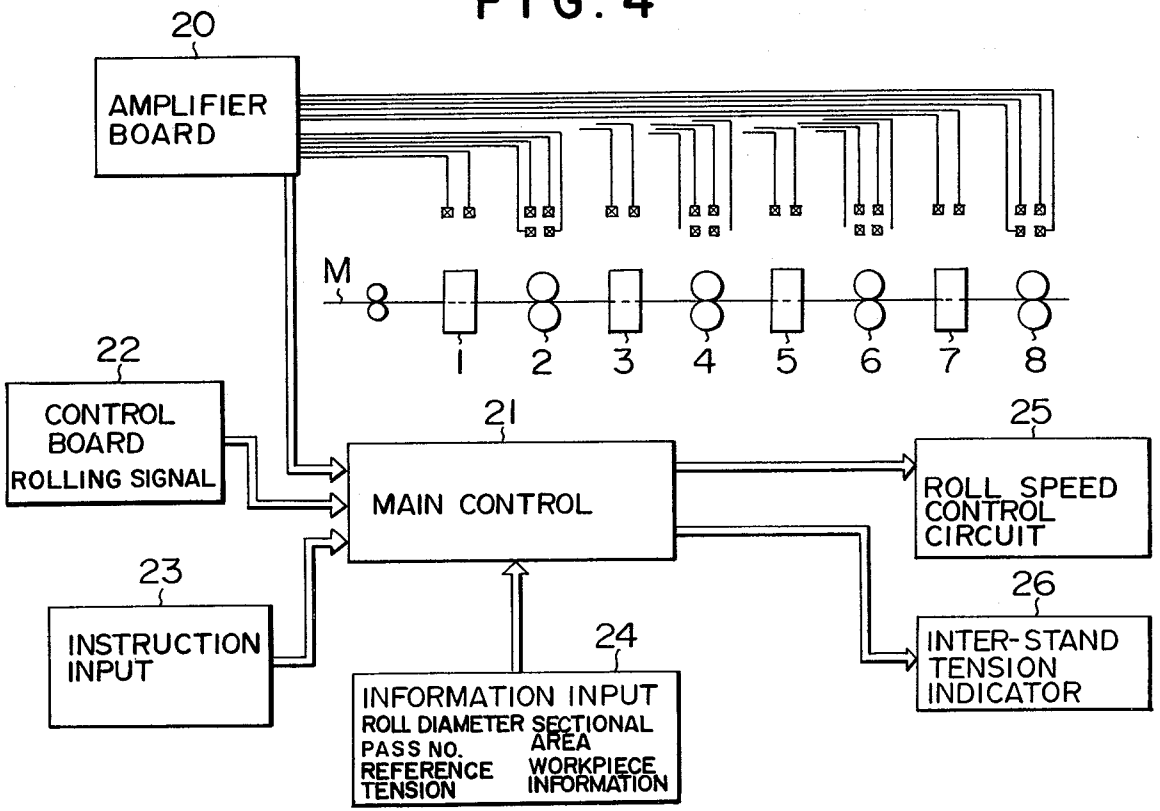
FIG. 4 is a schematic block diagram of a system for performing the inter-stand tension controlling method according to this invention.

Turning now to FIG. 4, there is shown a block diagram of a control system adapted to execute the interstand tension controlling method according to this invention for the eight stand tandem rolling mill as shown in FIG. 1 on the basis of tension data obtained from tension measuring devices provided as shown in FIGS. 1 and 2. The load sensing devices D are shown apart from the respective roll stands 1 through 8 of the eight stand tandem rolling mill for the purpose of simple illustration. The output from each load sensing device D is fed to an amplifier board 20 where it is amplified and the output from each delivery side load sensing device is compared with the output for the corresponding entry side load sensing device to produce a difference signal which is fed to a main control apparatus 21. Therefore, one difference signal is outputted for each vertical roll stand, whereas a left side or work side difference signal and a right side or drive side difference signal are outputted for each horizontal roll stand. When the output value from the delivery side load sensing device of a particular roll stand is higher than the output value from the corresponding entry side load sensing device, the difference signal is a positive signal representative of a positive tension in the workpiece between the particular roll stand of interest and the next succeeding roll stand.

A control console or board 22 in the operation room for the particular rolling mill supplies to the main control apparatus a capture or rolling signal for each roll stand which represents the fact that the workpiece is being captured or rolled in the respective roll stand. As is well-known, the bite or rolling signal can be obtained by detecting the sharp increase in roll driving motor current occurring when the workpiece has been just captured by the work rolls of each stand and the decrease in roll driving current occurring when the trailing end of the workpiece has just passed through the work rolls.

Alternatively, the capture or rolling signal may be given by discriminating the increase and decrease in output value from a roll load or force detecting device (not shown) provided on each rolling mill stand.

Furthermore, capture and pass-through of the workpiece can be detected on the basis of the change in output values of the entry side and delivery side load sensing devices provided on each rolling stand or the change in the sum of those output values. Namely, when the workpiece is being captured by the work rolls, the workpieces exerts force on the work rolls to separate them from each other. Since the rolling mill stand is of rigid joint the force exerted by the workpiece causes the entry side and delivery side stand housing posts to bend toward the work rolls, to thereby increase the output values of the entry side and the delivery side load sensing devices of the roll stand concerned. Therefore, positive detection of capture and pass-through of the workpiece can be made of detecting the increase and decrease in output signals from the entry side and delivery side load sensing devices or in the sum of these output signals.

An operator command input device 23 is operated by an operator to supply to the main control apparatus a command signal as to whether tension control should be executed or not.

An information input apparatus 24 supplies necessary information for tension control to the main control apparatus 21. To this information input apparatus 24 are inputted or preset the work roll diameter of each of the rolling mill stands 1 through 8, pass number being or to be used for each work roll, a reference or desired tension for each inter-stand, sectional area for each pass, tension influence coefficient, and workpiece information. These inputted data are outputted to the main control apparatus 21. The pass number information concerns the rolling pass position of the work roll for deriving the distance between the rolling pass and the load sensing device in the axial direction of the work roll of interest. In the case that load sensing devices are provided only at one side of the rolling mill housing as in the vertical roll stand shown in FIG. 2, since the correction coefficient $K_C$ varies with the rolling position of the work roll, namely, the rolling pass position, the coefficient $K_C$ must be derived on the basis of the inputted pass number information.

The reference or desired tension value is set for each pair of stands. In certain cases, it has been found that, for some reason, it is better for the inter-stand tension to be positive to an extent not affecting the gauge of the workpiece being rolled rather than for it to be zero. Therefore, a suitable reference or desired tension value is determined on the basis of the quality, gauge and shape of the workpiece. The reference or desired tension value is freely modified during rolling operation.

The sectional area of the pass is determined for each rolling stand as a part of rolling schedule on the basis of the quality, gauge and shape of the workpiece, the gauge and shape of the rolled product, etc. as well-known by those skilled in the art. Such sectional area of pass is inputted for each stand. This sectional area of pass is required for deriving tension per unit sectional area, i.e., stress of the workpiece by dividing each inter-stand tension by the sectional area of pass in the upstream stand of the respective pairs of rolling stands.

The tension influence coefficient is necessary for the following reason. As is well-known, when the workpiece is being rolled in the multistand tandem rolling mill with no inter-stand tension, the roll speed ratio between each pair of stands is in a predetermined relation determined by the theory in rolling that volume velocity of a workpiece being rolled is constant at any point. When tension occurs in the workpiece between some pair of rolling stands because of disturbance of the zero tension condition, the inventors of this invention found that the tension $\alpha_i$ occurring and an inter-stand speed unbalance $\Delta UV_i$ representative of the rate of deviation from the roll speed determined by a predetermined roll speed ratio lie in a linear relation as expressed in the following equation:

$$\alpha_i = (a_{i1}, a_{i2}, \ldots, a_{i,(n-1)} \begin{bmatrix} \Delta UV_1 \\ \Delta UV_2 \\ \vdots \\ \Delta UV_{(n-1)} \end{bmatrix} \quad (6)$$

$$(i = 1 \text{ through } (n-1))$$

where $\alpha_i$:—inter-stand tension between $(i)$th and $(i+1)$th stands.

$a_{ij}$:—matrix of coefficients determined by multi-stand rolling mill, rolling schedule, etc.

$\Delta UV_i$:—speed unbalance between the $(i)$th and $(i+1)$th stands

The matrix $(a_{ij})$ can be obtained by causing a speed unbalance between any pair of adjacent roll stands while maintaining roll speed of the other roll stands at the same ratio as those which have been determined with a free tension schedule, measuring inter-stand tension $\alpha_i$ between each pair of stands in such a condition and repeating the above steps while sequentially causing a speed unbalance in each of the remaining pairs of the stands. Alternatively, the matrix may be obtained in a theoretical manner.

Here assume that the reference or desired tension between the $(i)$th and $(i+1)$th stands is $\alpha_{0i}$, the speed modification rate $\Delta UV_i$ for controlling the actual tension $\alpha_i$ to the desired tension can be expressed by the following equation from the equation (6).

$$UV_i = (b_{i1}, b_{i2} \ldots\ldots, b_{i(n-1)} \begin{bmatrix} \alpha_1 - \alpha_{01} \\ \alpha_2 - \alpha_{02} \\ \vdots \\ \alpha_{(n-1)} - \alpha_{0(n-1)} \end{bmatrix} \quad (7)$$

$$(i = 1 \text{ through } (n-1))$$

where $(b_{ij})$:—inverse matrix of $(a_{ij})$

Therefore, when the workpiece is being rolled in three or more rolling stands, the speed unbalance having occurred between one pair of stands will affect the tension in the workpiece between other pairs of stands. In the other words, when inter-stand tension control is being performed, in order to alter the speed ratio between some stand and the next succeeding stand, tension deviations between the other stands must be taken into consideration.

The inventors also found that the speed modification rate $\Delta UV_i$ is governed substantially by the components $bi, (i-1)$; $bi, i$; $bi, (i+1)$ of the matrix $(b_{ij})$. Thus the equation (7) can be approximately expressed as follows:

$$\Delta UV_i = bi, (i-1)(\alpha_{(i-1)} - \alpha_{0(i-1)}) + bi, i(\alpha_i - \alpha_{0i}) + bi, (i+1)(\alpha_{(i+1)} - \alpha_{0(i+1)}) \quad (8)$$

Further, it has been found that the component $bi, (i-1)$ is small as compared with the remaining two components $bi\ i$ and $bi, (i+1)$ so that disregarding the component $bi, (i-1)$ has no affect on actual tension control. Accordingly, the equation (7) can be more approximately expressed as follows:

$$\Delta UV_1 = b_{ii}(\alpha_i - \alpha_{0i}) + b_{i(i+1)}(\alpha_{(i+1)} - \alpha_{0(i+1)}) \quad (9)$$

These components $b_{ij}$ of the inverse matrix are herein called "tension influence coefficient $\beta_{ij}$".

The workpiece information relates to the temperature, quality and gauge of the workpiece, etc., for adjustment or setting of gain of the tension control system.

The main control apparatus 21, which receives the various above-mentioned kinds of information from the amplifier board 20, the control board 22 and the information input apparatus 24, outputs speed modification rate signals as tension control signals to speed control circuits 25 associated with the respective roll stands and also outputs tension signals to tension indicators 26 provided between each pair of roll stands.

Figure 5A:
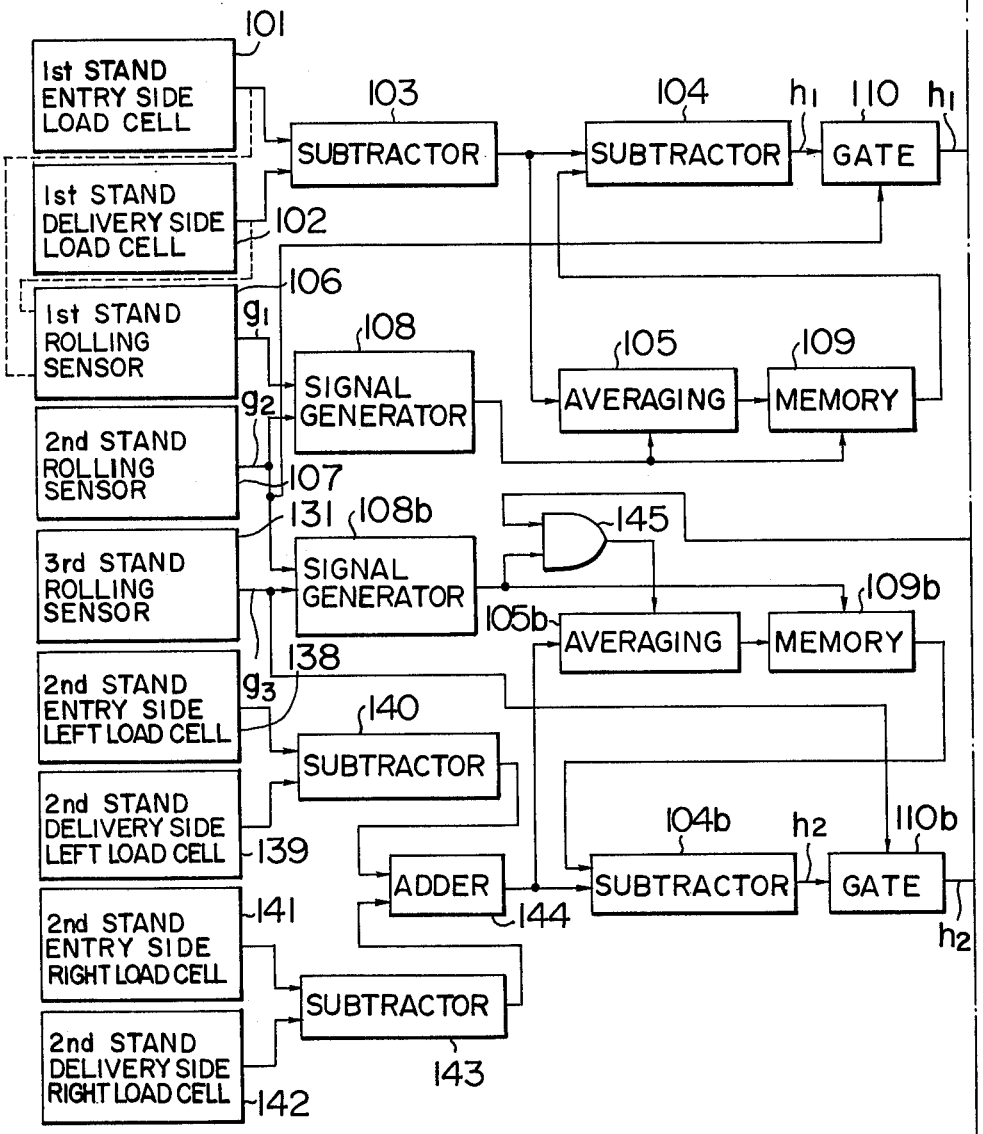
FIGS. 5A, 5B and 5C are block diagrams showing the construction of the main control apparatus shown in FIG. 4.
Figure 5B:
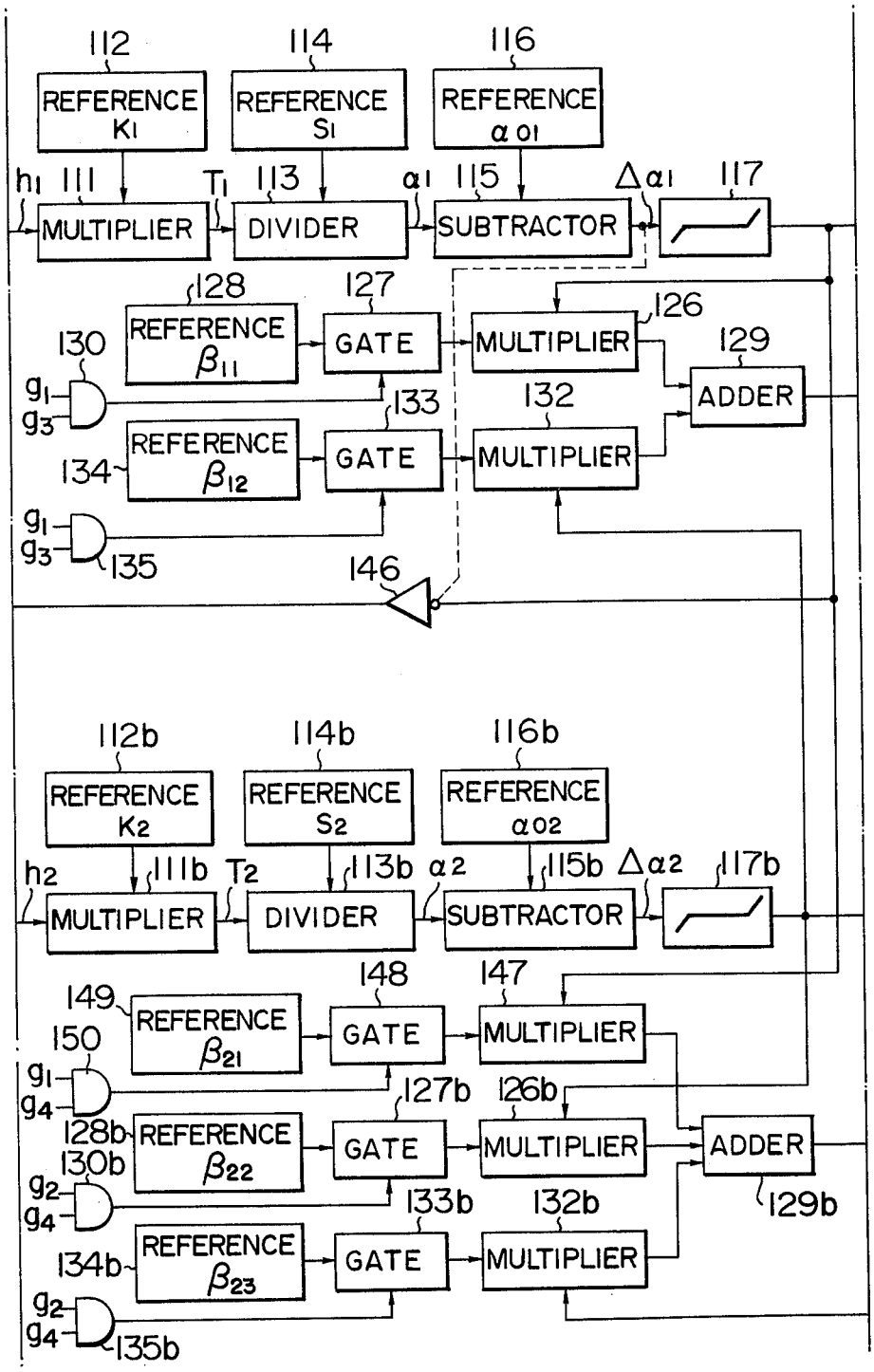
Figures 5C, 6:
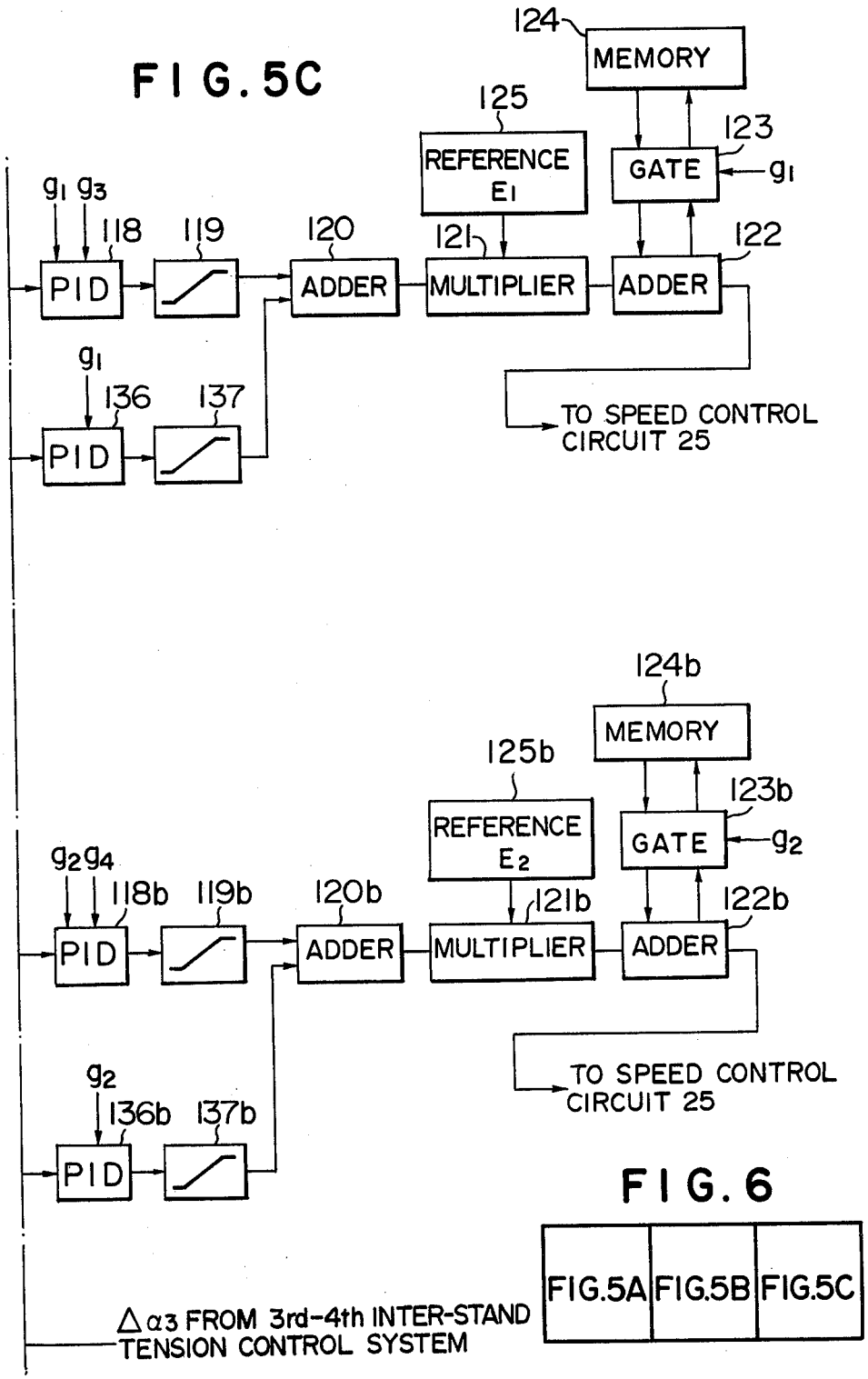
FIG. 6 shows the manner in which the block diagrams of FIGS. 5A, 5B and 5C are combined.

FIGS. 5A, 5B and 5C are block diagrams showing the first-second inter-stand tension control system and the second-third inter-stand tension control system of the main control apparatus shown in FIG. 4.

Output signals from the entry side load sensing device $D_e$, 101 and the delivery side load sensing device $D_d$, 102 provided in the first rolling mill stand are inputted to a subtractor 103, which in turn outputs the difference signal to a subtractor 104 and an averaging circuit 105 in the main control apparatus 21. First stand rolling sensor 106 and second stand rolling sensor 107 in the control board 22 generate capture or rolling signals which are fed to a first signal generator 108. This generator produces a first signal for the period during which the workpiece is being rolled by the first rolling stand but has not yet been captured in the second rolling stand. As previously mentioned, the rolling sensor may be of the type which detects the change in driving current in the associated roll driving motor or the change in output value from the associated rolling force or load sensor. Alternatively, the rolling sensor may detect the change in the output of the related entry side or delivery side load sensing devices or in the sum of both outputs. For this purpose, the outputs of the load sensing devices 101 and 102 may be also connected to the first stand rolling sensor 106 as shown by the dotted lines in FIG. 5A. The rolling sensors generate long pulses each rising up when the workpiece has been just captured by the related rolling stand and falling down when the workpiece has just passed through the rolling stand.

The first signal generator 108 outputs the first signal to the averaging circuit 105, which in turn begins to average the output signal from the subtractor 103 at the rising of the first signal. The averaging circuit 105 terminates its averaging operation at the falling of the first signal and then outputs the averaged value signal to a memory 109. The memory 109 is cleared at the leading edge of the first signal from the first generator 108, and a gate of the memory is opened at the trailing edge of the first signal so that the averaged value signal is stored in the memory which continues to supply the stored averaged value to the subtractor 104 until it is cleared. The averaged value stored in memory is representative of a mean value of a force in the workpiece acting on the load sensing device through the roll and the roll chock when the workpiece is being captured only by the first roll stand.

The subtractor 104, which receives the output signal from the subtractor 103 and the averaged value signal from the memory 109, outputs to a gate 110 a signal $h_1$ representative of the value obtained by subtracting the averaged value from the output value. The gate 110 is opened at the rolling signal from the second stand rolling sensor 107 so that the signal $h_1$ is connected from the subtractor 104 to one input of a multiplier 111. This multiplier 111 has its second input connected to a correction coefficient circuit 112 to receive a correction coefficient $k_1$, and outputs to the first input of a divider 113 a tension signal $T_1$ obtained by multiplying the signal $h_1$ by the coefficient signal $k_1$. The correction coefficient circuit 112 is set to generate the signal $k_1$ representative of the product of the correction coefficient $K_{C1}$ derived from the number of the pass being used on the work roll of the first stand and the correction coefficient $K_{D1}$ derived from the diameter of the work roll, which have been previously inputted into the information input apparatus 24.

The divider 113 has the second input connected to a first stand pass sectional area circuit 114 in the information input apparatus to receive a sectional area signal $S_1$. The divider 113 outputs to the first input of a subtractor 115 a stress signal $\alpha_1$ obtained by dividing the tension signal T by a sectional area signal $S_1$. The subtractor 115 receives at its other input the reference or desired stress signal $\alpha_{01}$ from a reference or desired first-second inter-stand stress circuit 116, and produces a stress error or deviation signal $\Delta\alpha_1$ which is fed to a functional amplifier 117. This functional amplifier has input-to-output characteristics as shown in the box 117 in FIG. 5B and hence has a dead band.

An output signal from the functional amplifier 117 having the dead band is connected to an input of a proportional, integral and differential circuit (PID) 118 whose output is connected through a limiter 119 to the first input of an adder 120. The adder 120 has its output connected to a multiplier 121 where the inputted signal is multiplied by a conversion coefficient signal $E_1$ from a signal conversion coefficient circuit 125 in the information input apparatus 24. The multiplier 121 has its output connected to the first input of an adder 122. The adder 122 has the second input connected through a gate 123 to a memory 124 to receive a stored signal in the memory and to add it to the output signal from the multiplier 121 so as to present a speed modification rate signal to the speed control circuit 25.

The output from the functional amplifier 117 is also connected to the first input of a multiplier 126 whose second input is connected through a gate 127 to a tension influence coefficient circuit 128 to receive the tension influence coefficient signal $\beta_{11}$ to thereby produce the output signal representative of the product of the tension deviation $\Delta\alpha_1$ and the tension influence coefficient $\beta_{11}$. The output signal is connected to the first input of an adder 129. The gate 127 is controlled by the output signal from an AND gate 130, which has as inputs the first stand rolling signal $g_1$ and the third stand rolling signal $g_3$ from a third stand rolling sensor 131, to supply the influence coefficient signal to the multiplier 126 only during the time period from the moment the leading end of the workpiece has been captured by the third roll stand to the moment the trailing end of the workpiece has passed through the first roll stand. The multiplier 126 is adapted to present zero value signal to the adder 129 when the influence coefficient signal is not supplied to the multiplier. The second input of the adder 129 is connected to the output of an multiplier 132 which has as its first input a tension deviation signal from the second-third inter-stand tension control system, which will be explained hereinafter. The second input of the multiplier 132 is connected through a gate 133 to another tension influence coefficient circuit 134 to receive the influence coefficient signal $\beta_{12}$ therefrom. The gate 133 is controlled by the output from an AND gate 135, which has the first and third stand rolling signals $g_1$ and $g_3$ as inputs, to operate in the same manner as the gate 127. The multiplier 132 outputs zero value signal at the time of receiving no influence coefficient signal, as in the case of the multiplier 126. The output of the adder 129 is connected through a proportional, integral and differential circuit PID 136 and a limiter 137 to the second input of the adder 120. Therefore, the adder 120 adds the output from limiter 137 to the output from the limiter 119 to present a sum signal which is fed to the multiplier 121.

At the leading edge of the third stand rolling signal $g_3$, PID 118 stops performing a PID function and holds its output signal produced at that time which is fed to the first input of the adder 120 through the limiter 119. PID 118 is reset at the trailing edge of the first stand rolling signal $g_1$, PID 136 is also reset at the falling of the first stand rolling signal $g_1$.

The gate 123 located between the adder 122 and the memory 124 operates, at the trailing edge of the first stand rolling signal $g_1$, to clear the memory and at the same time to store the output signal from the adder 122 in the memory. The stored signal in the memory is held and outputted through the gate 123 to the adder 122 until the memory is cleared at the trailing edge of the next first stand rolling signal. The memory 124 may be of the analog type. But, since drift occurs in the hold signal in the analog memory, it is preferable to use a digital memory which includes an analog-to-digital converter for converting the input signal into a format suitable to be written into the memory and a digital-to-analog converter for converting the output read out of the memory into an analog signal.

The construction of the second-third inter-stand tension control system will now be explained. Note, however that the same portions as those of the first-second inter-stand tension control system are given the same reference numerals appended with the appendix "*b*," and explanation on the same construction portions will here be omitted.

Detection signals from the entry side load sensing device $D_{le}$, 138 and the delivery side load sensing device $D_{ld}$ 139 provided on the left roll chock of the second roll stand are fed to a subtractor 140 which presents the difference signal to one input of an adder 144. On the other hand, detection signals from the entry side load sensing device $D_{re}$, 141 and the delivery side load sensing device $D_{rd}$, 142 provided on the right roll chock of the second roll stand are fed to a subtractor 143, which in turn presents the difference signal to the other input of the adder 144. The adder 144 has its output connected to the first input of a subtractor 104*b*and the input of an averaging circuit 105*b*.

A second signal generator 108*b* has its first input connected to the second rolling sensor 107 to receive the second rolling signal $g_2$ and its second input connected to the third rolling sensor 131 to receive the third rolling signal $g_3$. The generator 108*b* produces a second signal rising up at the capture of workpiece into the second stand and falling down at the capture of workpiece into the third stand, which is fed to one input of an AND gate 145 whose output is connected to a gate input of the averaging circuit 105*b*. The other input of the AND gate 145 is connected to the output of the functional amplifier 117 through an inverter 146, so that the averaging circuit 105 averages the output from the adder 144 in the condition where the workpiece is captured in the second stand and has not yet been captured by the third stand and when the output of the functional amplifier is zero value, i.e., when the actual first-second inter-stand tension differs from the desired value by less than a certain amount. Alternatively, the output of the subtractor 115 may instead be connected to the inverter as shown by the dotted line in FIG. 5 so that the averaging circuit 105*b* carries out its averaging operation when the output of the subtractor 115 is zero value, namely, when the actual first-second inter-stand tension is consistent with the desired tension.

The correction coefficient $K_2$ set in the correction coefficient circuit 112*b* is the $K_{D2}$ derived from the work roll diameter of the second stand. In the second rolling stand which is of the horizontal roll type, since the load sensing devices are located at the opposite sides of the work roll it is not necessary to correct the measured value on the basis of the position of the pass of the work roll in use.

PID 118*b* stops performing a PID function at the leading edge of a fourth stand rolling signal $g_4$ from a fourth rolling sensor (not shown) and holds its output signal produced at that time. PID 118*b* then supplies the held output signal to an adder 120*b* through a limiter 119*b* until the PID is reset at the trailing edge of the second stand rolling signal $g_2$. Also, PID 136*b* is reset at the trailing edge of the second stand rolling signal $g_2$. Furthermore, the operation of a gate 123*b* is controlled at the trailing edge of the second stand rolling signal.

The adder 129*b* is a three input adder which receives as inputs the output from a multiplier 147 in addition to the outputs from multipliers 126*b* and 132*b*. The multiplier 147 has its first input connected to the functional amplifier 117 and its second input connected through a gate 148 to a tension influence coefficient circuit 149 to receive the influence coefficient signal $\beta 21$. The gate 148 is controlled by the output of an AND gate 150 which has the fourth and first rolling signals $g_4$ and $g_1$ as inputs. The multiplier 126*b* receives the tension deviation signal $\Delta\alpha_2$ from a functional amplifier 117*b*, and the multiplier 132*b* receives the tension deviation signal $\Delta\alpha_3$ from a third-fourth inter-stand tension control system (not shown). The fourth and second rolling signals $g_4$ and $g_2$ are connected to AND gates 130*b* and 135*b* which present control signals to gates 127*b* and 133*b*, respectively.

The third-fourth to seventh-eighth inter-stand tension control systems have substantially the same construction as that of the second-third inter-stand tension control system, and therefore, explanation thereof will here be omitted.

Next, operation of the first-second and second-third inter-stand tension control systems will be explained. In the rolling mill shown in FIG. 1, when the workpiece has not yet been captured by the first rolling stand, all work rolls of the first to eighth stands are driven at the preset speed. At the moment the workpiece has been captured by the first stand, the averaging circuit 105 starts to average the output signal from the subtractor 103. At this time, the gate 110 is in a closed condition, and the work rolls of the first stand continue to be driven at the preset speed.

When the leading end of the workpiece has been just captured by the second rolling stand, the averaging circuit 105 terminates the averaging operation and outputs the averaged value signal to the memory 109. At this same time, the gate 110 is opened by the second stand rolling signal $g_2$, and the subtractor 104, which receives the output signal from the subtractor 103 and the averaged value signal from the memory 109, generates the signal $h_1$ which is fed to one input of the multiplier 111. The multiplier 111, which receives at the other input thereof the correction coefficient signal $K_1$ derived from the rolling position and the roll diameter, produces the tension signal $T_1$ which is fed to the divider 113. The divider 113 divides the tension signal $T_1$ by the sectional area signal $S_1$ to generate the stress signal $\alpha_1$ which is fed to the subtractor 115. The subtractor 115 outputs the deviation signal $\Delta\alpha_1$ representative of the error or difference between the actual streass $\alpha_1$ and the reference or desired stress value $\alpha_{01}$. The deviation signal $\Delta\alpha_1$ is fed through the functional amplifier 117 having the dead band, the PID 118, the limiter 119 and the adder 120 to the multiplier 121. At this time, since the adder 120 receives the zero value signal at the second input thereof, the adder 120 outputs the output of the limiter 119 as it is. The multiplier 121 multiplies the signal fed from the adder 120 by the conversion coefficient signal $E_1$ from the signal conversion coefficient circuit 125, and outputs the multiplied signal to the adder 122. The adder 122 also recieves through the gate 123 the signal which has been stored in the memory 124 when the trailing end of the preceding workpiece has been rolled, and outputs the speed modification rate signal to the speed control circuit 25. Such control operation continues until the leading end of the workpiece is captured by the third rolling stand.

As will be apparent from the above, during the period in which the workpiece is captured by only the first and second stands, the tension control for the workpiece between the first and second stand is carried out without consideration for the rolling condition in the third and subsequent rolling stands.

Now, if the workpiece is captured by the third stand, the third stand rolling sensor 131 presents the rolling signal $g_3$ to the gates 127 and 133 to open them. Consequentially, the multiplier 126 outputs to the first input of the adder 129 a signal of the value obtained by multiplying the tension deviation $\Delta\alpha_1$ by the influence coefficient $\beta_{11}$, and on the other hand, the multiplier 132 outputs to the second input of the adder 129 the signal representative of the product of the influence coefficient $\beta_{12}$ and the tension deviation $\Delta\alpha_2$ from the functional amplifier **117*b* in the second-third inter-stand tension control system. The adder 129 adds these input signals $\beta_{11}\Delta\alpha_1$ and $\beta_{12}\Delta\alpha_2$ and outputs the added signal to the PID 136 as the stress error or deviation signal $\Delta\alpha_{N1}$. The following equation expresses the operation executed by the multipliers 126 and 132 and the adder 129**.

$$\Delta\alpha_{N1} = \beta_{11}\Delta\alpha_1 + \beta_{12}\Delta\alpha_2 \quad (10)$$

It will be noted from a comparison of this equation (10) with the equation (9) that the multipliers 126 and 132 and the adder 129 perform the operation processing expressed by the equation (9).

The output $\Delta\alpha_{N1}$ from the adder 129 is fed through the PID 136 and the limiter 137 to the second input of the adder 120. On the one hand, the PID 118 stops performing a PID function at the leading edge of the third stand rolling signal $g_3$, namely, at the moment the leading end of the workpiece has been captured by the third stand and holds its output signal produced at that time. While the leading end of the workpiece advances from the second stand to the third stand, the inter-stand tension between the first and second stands is controlled to or near the desired tension value. Therefore, after the capture of the workpiece by the third stand, the signal held in the PID 118 is fed to the adder 120 as a base control signal. Thus, the adder 120 adds the output signal $\Delta\alpha_{N1}$ from the limiter 137 to the base control signal held in and fed from the PID 118, and presents the output signal to the multiplier 121. Therefore, there is produced a signal representative of the stress deviation or speed modification rate which enables a more accurate inter-stand tension control having taken into full consideration interaction between the inter-stand tension of a given pair of stands and the inter-stand tension of the other pairs of stands.

The above mentioned mode of operation continues till the moment the trailing end of the workpiece has passed through the first stand. At that moment, i.e., at the trailing edge of the first stand rolling signal $g_1$, the gate 123 clears the memory 124 and to cause the memory 124 to store the output signal of the adder 122. After this, the new held signal is fed through the adder 122 to the speed control circuit. Therefore, the roll speed at the moment the trailing end of the workpiece has passed through the rolling stand is maintained as it is for the purpose of establishing the desired tension in the next succeeding workpiece when it is captured by the rolling mill. The PID 118 and 136 are also reset at the trailing edge of the first stand rolling signal.

Next, the operation of the second-third inter-stand tension control system will be explained. Note, however, that explanation will be made only on those points which differ in operation from the corresponding portions of the first-second inter-stand tension control system.

The averaging circuit **105*b* is controlled with the output from the AND gate 145 which receives at the first input the second signal from the second generator 108*b* and at the second input the inversed output of the functional amplifier 117, so as to sample the output signal from the adder 144 while the second generator 108*b* generates the second signal and when the output of the functional amplifier 117 is zero. In the other words, the averaging circuit 105*b* averages the force acting on the tension measuring device when the actual first-second interstand tension differs from the reference or desired tension by less than a certain amount, namely, when the actual tension between the first and second stand has no substantial effect on inter-stand tensions of the other pairs of stands. Thus, the difference between the averaged value obtained by the averaging circuit 105*b* and the measured value of the horizontal force detected by the tension measuring device after the workpiece has been captured by the third stand is accurately representative of the actual tension acting on the workpiece between the second and third stands. In the case that the input of the inverter 146 is connected to the output of the subtractor 115 instead of the output of the functional amplifier 117 as shown by the dotted line, the averaging circuit 105*b* samples the output from the adder 144** only when the actual first-second interstand tension is consistent with the desired value.

The multiplier 147 multiplies the first-second inter-stand tension deviation signal $\Delta\alpha_1$ from the functional amplifier 117 by the influence coefficient signal $\beta_{21}$ to present the product signal $\beta_{21}\Delta\alpha_1$ to the adder 129 while the gate 148 is opened. Thus, the operation executed by the mulipliers 147, **126*b* and 132*b* and the adder 129*b*** can be expressed as follows:

$$\Delta\alpha_{N2} = \Delta_{21}\Delta\alpha_1 + \beta_{22}\Delta\alpha_2 + \beta_{23}\Delta\alpha_3 \quad (11)$$

Comparing this equation (11) with the equation (8) previously mentioned, it will be noted that the multipliers 147, **126*b* and 132*b* and the adder 129*b* co-operate to execute the operational processing expressed by the equation (8). Since the gate 148 is controlled by the output of the AND gate 150 which receives the first and fourth rolling signals $g_1$ and $g_4$, after the trailing end of the workpiece has passed through the first stand, the influence coefficient signal $\beta_{21}$ is not fed to the multiplier 147**. The following equation expresses the signal processing carried out during the period from when the trailing end of the workpiece has passed through the first stand to when the trailing end of the workpiece has passed through the second stand.

$$\Delta\alpha_{N2} = \beta_{22}\Delta\alpha_2 + \beta_{23}\Delta\alpha_{23} \quad (12)$$

Since the coefficient $\beta_{i(i-1)}$ is smaller than $\beta_{i,i}$ and $\beta_{i(i+1)}$, the above signal processing has no substantial effect on the tension control. Thus, the multiplier 147, the gate 148 and the influence coefficient circuit 149 may be omitted as in the first-second inter-stand tension control system.

Figure 7A:
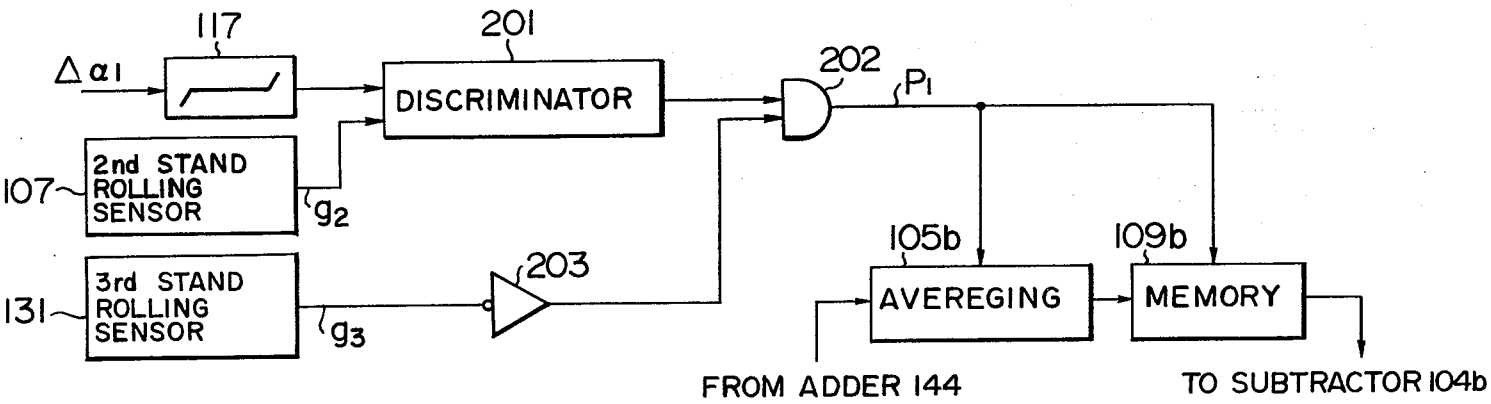
FIG. 7A is a block diagram showing a modification of a portion of the circuitry showing FIG. 5.

FIG. 7A shows one modification of the controlling circuit for the averaging circuit 105b shown in FIG. 5. In this embodiment, the tension deviation signal $\Delta\alpha_1$ from the functional amplifier 117 and the second rolling signal $g_2$ from the second stand rolling sensor 107 are fed to a discriminator 201 which is constructed to generate a signal when zero signal from the functional amplifier 117 continues for a predetermined time period after the workpiece is captured by the second stand. The discriminator supplies the signal to one input of an AND gate 202 till the trailing end of the workpiece has passed through the second stand. The other input of the AND gate 202 is connected through an inverter 203 to the output of the third stand rolling sensor 131. Therefore, the AND gate 202 outputs to the control input of the averaging circuit 105b a pulse $P_1$ rising up at the leading edge of the signal from the discriminator 201 and falling down at the leading edge of the third stand rolling signal $g_3$. The averating circuit 105b is reset at the leading edge of the pulse $P_1$ and at the same time starts to average the output signal from the adder 144. At the trailing edge of the pulse $P_1$, the memory 109b is cleared and the averaged value signal from the averaging circuit 105b is stored in the memory 109b.

The new stored signal in the memory is fed to the subtractor 104b. The above mentioned construction is advantageous in actual tension control for the following reasons. If the actual interstand tension between a given pair of stands is maintained at the desired tension value for more than a predetermined time period, the tension control can be regarded as having become stable. Therefore, initiation of averaging operation from that time will provide sufficient time for the averaging operation, whereby reliable averaged value can be obtained.

Figure 7B:
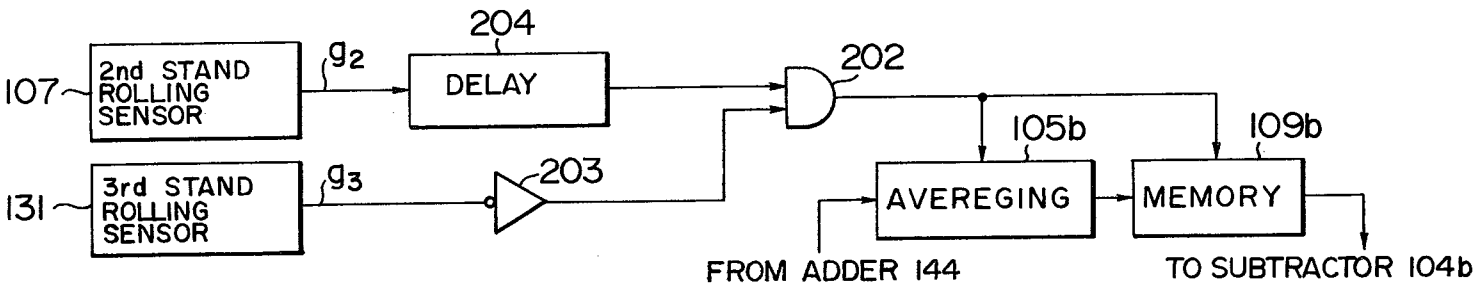
FIG. 7B is a block diagram showing another modification of the circuit shown in FIG. 7A.

Referring now to FIG. 7B, there is shown a modification of the control circuit shown in FIG. 7A. In this modified embodiment, a delay circuit 204 is provided in place of the discriminator 201 in the embodiment shown in FIG. 7A. It has been found from experience that the inter-stand tension between a given pair of stands is controlled at or in proximity to the desired value within a suitable time period after the workpiece has been captured by the given pair of stands. Therefore, the second stand rolling signal $g_2$ is delayed by the delay circuit 204 for such a suitable time to be fed to the one input of the AND gate 202.

Figure 8:
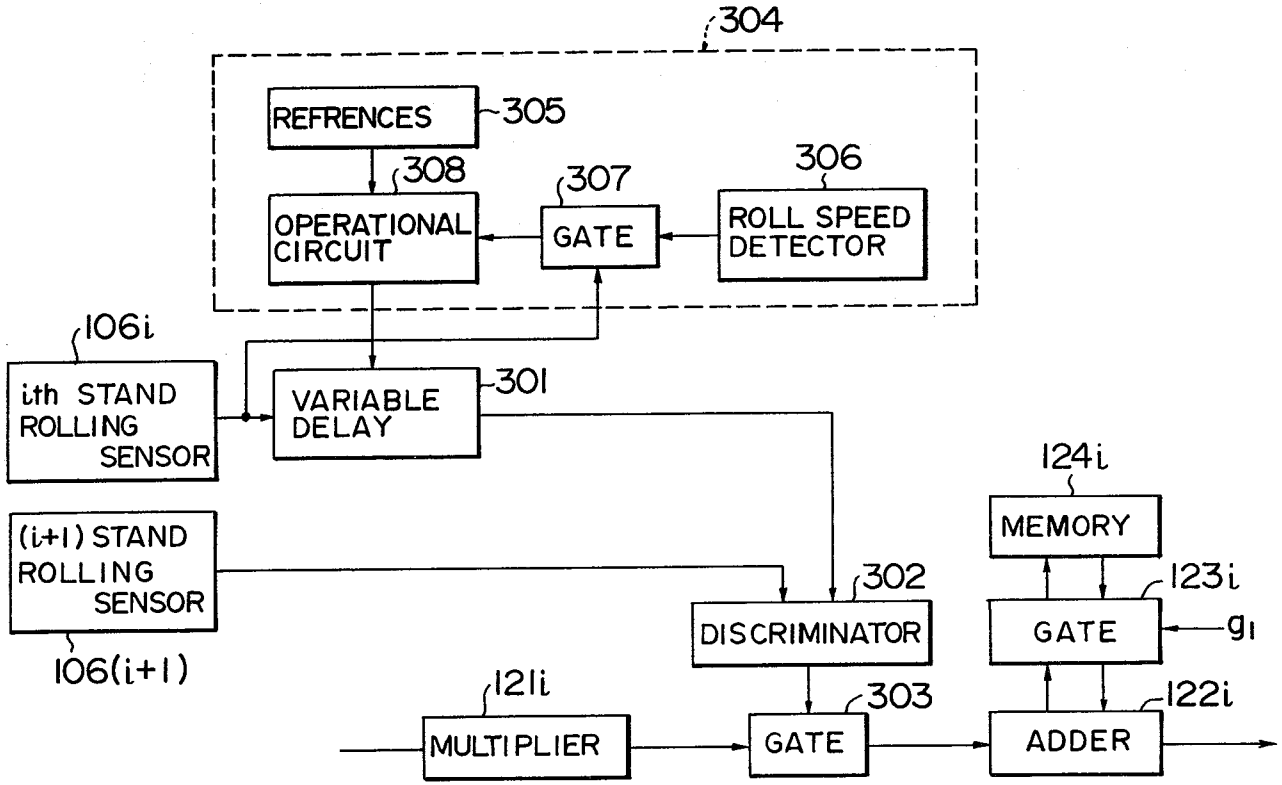
FIG. 8 is a block diagram of a safety circuit usable in cooperation with the system of FIG. 5.

FIG. 8 is a block diagram showing another modification of the apparatus shown in FIG. 5. In control of multi-stand tandem rolling mills, when one or more rolling sensors break down, if the control system runs as it is, serious trouble will occur in the control operation and hence in the rolling operation. The embodiment shown in FIG. 8 is a safety circuit for the (*i*)th – (*i*+1)th inter-stand tension control system for the purpose of preventing such trouble in control operation. The (*i*)th stand rolling signal $g_i$ from the (*i*)th stand rolling sensor **106*i* is fed through a variable delay circuit 301 to a discriminator 302**. The (*i*+1)th stand rolling signal $g_{(i+1)}$ from the (*i*+1)th stand rolling sensor 106(*i*+1) is directly fed to the discriminator 302. When the delayed (*i*)th stand rolling signal is fed to the discriminator 302 perior to the (*i*+1)th stand rolling signal $g_{(i+1)}$, the discriminator 302 operates to close a gate 303 between the multiplier **121*i* and the adder 122*i*** in the (*i*)th – (*i*+1)th interstand tension control system. On the other hand, when the (*i*+1)th stand rolling signal is fed to the discriminator 302 prior to the delayed (*i*)th stand rolling signal, the discriminator 302 operates to open the gate 303 so that the output of the multiplier **121*i* is fed to the adder 122*i***.

The delay time of the variable delay circuit 301 is controlled by an operational and control circuit 304. The operational and control circuit 304 includes a reference circuit 305 in the information input apparatus, a roll speed sensor 306 provided in the (*i*)th rolling stand, a gate 307 and an operational circuit 308. The reference circuit 305 is set to generate signals representative of the distance Mi−(*i*+1) between the (*i*)th and (*i*+1)th stands and the roll diameter Di and the forward slip ratio *fi* of the (*i*)th stand. This signal is fed to the operational circuit 308. The (*i*)th stand rotational frequency signal $N_i$ from the sensor 301 is also fed to the operational circuit 308 through the gate 307 which is adapted to open at the leading edge of the (*i*)th stand rolling signal. The operation circuit 308 carries out the operation as expressed by the following equation:

$$t_i = \frac{Mi - (i+1)}{\pi D_i N_i (1 + fi)} \tag{13}$$

Namely, the operational circuit 308 generates a signal representative of the time period *ti* in which the leading edge of workpiece travels from the (*i*)th stand to the (*i*+1)th stand. By the traveling time signal *ti*, the variable delay circuit 301 is adjusted to have the delay time *td* corresponding to the traveling time $t_i$ plus the permissible delay time *tα* of the workpiece travel. Thus, if the (*i*+1)th stand rolling sensor 106(*i*+1) is broken-down, the gate 303 is closed so that control is carried out on the basis of the signal stored in the memory **124*i***.

Figure 9:
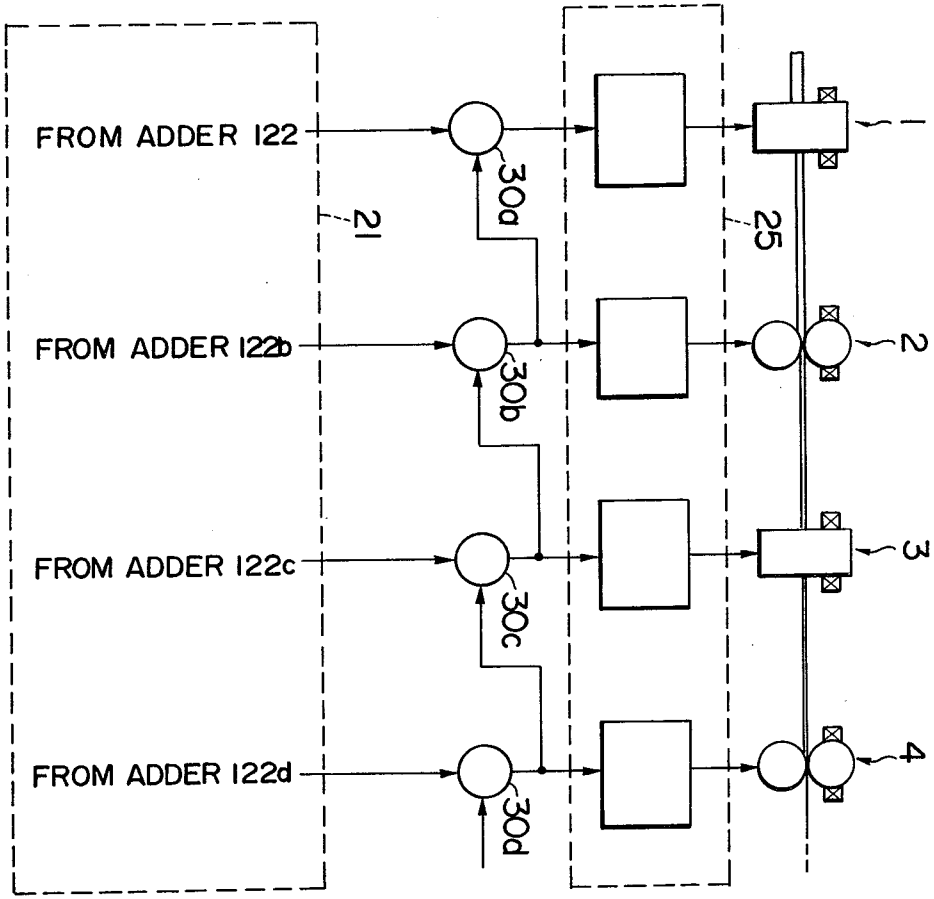
FIG. 9 is a circuit diagram of an interface between the speed control circuits for roll driving motors and the main control apparatus.

Referring to FIG. 9, there is shown an input circuit of the speed control circuit 25 for the roll driving motors in the rolling mill. In the case that the tension between the third and fourth stands is modified, alteration only in the rolling speed of the third stand disturbs the tension between the second and third stands. Therefore, in order to modify the tension between the third and fourth stands without disturbing tensions between the other pairs of stands, the rolling speeds of the first to third stands must be simultaneously altered by the same rate. For this purpose, as shown in FIG. 9, the speed modification rate signal for each stand is added to the speed modification rate signals for all stands upstream of that stand by adders (only the adders **30*a* to 30*d*** are shown), and the added signals are inputted to the speed control circuits for respective stands. Alternatively, the speed modification rate signal for each stand may be added to the speed modification rate signals for all stands downstream of that stand.

As seen from the above illustrated and described embodiments, according to this invention, a more accurate measurement of inter-stand tension can be obtained and inter-stand tension can be more accurately controlled.

It is apparent to those skilled in the art that the inter-stand tension control according to this invention can be carried not only by using analog circuit technique but also by using a digital computer technique.

It should be understood that various changes and modifications may be made without departing from the scope and spirit of this invention.

We claim:

1. A method of controlling inter-stand tension in a multi-stand rolling mill which is provided with a means for measuring tension acting on a workpiece portion between a given ($i$)th stand and the next succeeding ($i+1$)th stand, said tension means comprising at least one pair of load sensing devices provided at the entry and delivery sides of said ($i$)th stand to sense a force acting on a roll chock, comprising the steps of:

storing an output value from the tension measuring means in the condition where the workpiece is captured by the ($i$)th stand and has not yet been captured by the next succeeding ($i+1$)th stand and when the tension of the workpiece upstream of said ($i$)th stand has substantially reached a reference or desired value;

multiplying, after the workpiece has been captured by said succeeding ($i+1$)th stand, a difference value between the output value from the tension measuring means and said stored value by a predetermined correction coefficient K to obtain the value of actual tension acting on the workpiece between said ($i$)th stand and ($i+1$)th stands; and performing control of the rolling speed on the basis of an error or deviation between said tension value and a desired ($i$)th − ($i+1$)th inter-stand tension value.

2. A method set forth in claim 1 in which capture of workpiece by said ($i$)th stand is detected by detecting the change in the sum of the output values of said load sensing devices.

3. A method set forth in claim 1 in which capture of workpiece by said ($i$)th stand is detected by detecting the change in the output value of the rolling force sensor provided on said ($i$)th stand.

4. A method set forth in claim 1 in which capture of workpiece by said ($i$)th stand is detected by detecting the change in the roll driving current in said ($i$)th stand.

5. A method set forth in claim 1 in which when a predetermined time has elapsed after the workpiece has been captured by said ($i$)th stand the output value of said tension measuring means is stored.

6. A method set forth in claim 5 in which when a predetermined time has elapsed after the workpiece has been captured by said ($i$)th stand the output value of said tension measuring means is averaged and the averaged value is stored.

7. A method set forth in claim 1 in which when the tension in the workpiece between said ($i$)th stand and the adjacent upstream ($i-1$)th stand is consistent with the desired value, the output value of said tension measuring means is stored.

8. A method set forth in claim 7 in which while the tension in the workpiece between said ($i$)th stand and the adjacent upstream ($i-1$)th stand is consistent with the desired value, the output value of said tension measuring means is averaged and the averaged value is stored.

9. A method set forth in claim 1 in which while the tension in workpiece between said ($i$)th stand and the adjacent upstream ($i-1$)th stand differs from the desired value by less than a predetermined amount the output value of said measuring means is averaged and the averaged value is stored.

10. A method set forth in claim 1 in which when the time during which the tension in the workpiece between said ($i$)th stand and the adjacent upstream ($i-1$)th stand is consistent with the desired value exceeds a predetermined time, the output value of said tension measuring means is averaged and the averaged value is stored.

11. A method set forth in claim 1 in which said correctiong coefficient K is the following correction coefficient $K_D$ relative to the diameter of the ($i$)th stand roll:

$$K_D = (aD + b)/cD + d)$$

where D:—roll diameter $a, b, c, d$:—constant

12. A method set forth in claim 1 in which said correction coefficient K is the following correction coefficient $K_C$ relative to the rolling position on the ($i$)th stand roll:

$$K_C = Lr/(Lr - 1)$$

where

Lr:—roll length

1:—distance between the tension measuring means and the rolling position.

13. A method set forth in claim 1 in which said correction coefficient K is the product of the following correction coefficient $K_D$ relative to the diameter of the ($i$)th stand roll and the following correction coefficient $K_C$ relative to the rolling position of the ($i$)th stand roll:

$$K_D = (aD + b)/cD + d)$$

where

D:—roll diameter $a, b, c, d$:—constant and $$K_C = Lr/(Lr - 1)$$

where

Lr:—roll length

1:—distance between the tension measuring means and the rolling position.

14. A method set forth in claim 1 in which when the tension in the workpiece between said ($i$)th and ($i+1$)th stands is controlled at the desired value, the rolling speeds of said ($i$)th stand and all preceeding stands or said ($i+1$)th stand and all succeeding stands are simultaneously altered by the same rate.

15. A method set forth in claim 1 in which the control output for the roll driving motor of each stand is held when the trailing end of the workpiece has been passed through that stand.

16. A method of controlling inter-stand tension in a multi-stand rolling mill which is provided with an ($i$)th tension measuring means for measuring tension acting on a workpiece between an ($i$)th stand and the adjacent downstream ($i+1$)th stand and an ($i+1$)th tension measuring means for measuring tension of the workpiece between the ($i+1$)th stand and the adjacent downstream ($i+2$)th stand, characterized in that during the time period from the moment the leading end of the workpiece has been captured in the ($i+2$)th stand to the moment that trailing end of that workpiece has passed through the ($i$)th stand, the ($i$)th − ($i+1$)th inter-stand tension control is performed on the basis of a value which is obtained by multiplying ($i$)th − ($i+1$)th inter-stand tension error or deviation derived from the output value of the ($i$)th tension measuring means and ($i+1$)th − ($i+2$) interstand tension error or deviation derived from the output value of the ($i+1$)th tension measuring means respectively by tension influence coefficients $\beta l$, $i$ and $\beta i$, ($i+1$) which are respectively determined by rolling conditions and by summing these multiplied tension deviations.

17. A method set forth in claim 16 in which ($i-1$)th tension measuring means is further provided to measure tension acting on the workpiece between the ($i$)th stand and the adjacent upstream ($i-1$)th stand, and in which during the time period from the moment the leading end of the workpiece has been captured in the ($i+2$)th stand to the moment the trailing end of that workpiece has passed through the ($i-1$)th stand, the ($i$)th − ($i+1$)th inter-stand tension control is performed on the basis of a value which is obtained by multiplying ($i-1$)th − ($i$)th inter-stand tension error or deviation derived from the output value of the ($i-1$)th tension measuring means, ($i$)th − ($i+1$)th inter-stand tension error or deviation derived from the output value of the ($i$)th tension measuring means and ($i+1$)th − ($i+2$)th inter-stand tension error or deviation derived from the output value of the ($i+1$)th tension measuring means respectively by tension influence coefficients, $\beta$i, ($i-1$), $\beta i$, $i$ and $\beta i$, ($i+1$) which are respectively determined by rolling conditions and by summing these multiplied tension deviations.

* * * * *